US006640081B2

(12) United States Patent
Sato

(10) Patent No.: US 6,640,081 B2
(45) Date of Patent: Oct. 28, 2003

(54) IMAGE FORMING APPARATUS INCLUDING ELASTIC CLEANING BLADE WITH RESIN FILM FORMED ONLY AT ENDS THEREOF AND PROCESS CARTRIDGE INCLUDING SAME

(75) Inventor: Hiroshi Sato, Shizuoka (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/947,380

(22) Filed: Sep. 7, 2001

(65) Prior Publication Data

US 2002/0031384 A1 Mar. 14, 2002

(30) Foreign Application Priority Data

Sep. 13, 2000 (JP) ..... 2000-278402

(51) Int. Cl.[7] ..... G03G 15/00
(52) U.S. Cl. ..... 399/350; 15/256.5
(58) Field of Search ..... 399/343, 345, 399/346, 347, 350, 351; 15/256.5

(56) References Cited

U.S. PATENT DOCUMENTS 5,450,184 A * 9/1995 Yanai et al. ..... 399/350

5,646,718 A * 7/1997 Suwa et al. ..... 399/350

* cited by examiner

*Primary Examiner*—Hoang Ngo
(74) *Attorney, Agent, or Firm*—Fitzpatrick, Cella, Harper & Scinto

(57) ABSTRACT

An image forming apparatus includes an electrostatic latent image bearing member, a charging for uniformly charging a surface of the electrostatic latent image bearing member, a developing for visualizing an electrostatic latent image formed on the electrostatic latent image bearing member with a developer, a transferring device for transferring a developer image formed on the electrostatic latent image bearing member to a transferring material, and a cleaning device for cleaning the surface of the electrostatic latent image bearing member by bringing a cleaning blade consisting of an elastic blade into contact with the surface of the electrostatic latent image bearing member. The cleaning blade includes a portion to be brought into contact with the surface of the electrostatic latent image bearing member and resin films are formed on surface areas at both ends outside a developing area in a longitudinal direction. A portion of the elastic blade corresponding to the developing area is free of resin film. The elastic blade may be included in a process cartridge.

14 Claims, 4 Drawing Sheets

IMAGE FORMING APPARATUS INCLUDING ELASTIC CLEANING BLADE WITH RESIN FILM FORMED ONLY AT ENDS THEREOF AND PROCESS CARTRIDGE INCLUDING SAME

BACKGROUND OF THE INVENTION

Field of the Invention and Related Background Arts

The present invention relates to an image forming apparatus which has at least an electrostatic latent image bearing member and a cleaning blade for cleaning a surface of the above described electrostatic latent image bearing member as well as a process cartridge detachably attachable to the above described image forming apparatus.

An image forming apparatus such as a printer forms an electrostatic latent image by exposing to light a photosensitive drum which is a uniformly charged electrostatic latent image bearing member, forms a toner image by visualizing the electrostatic latent image with a toner and records an image by transferring the above described toner image to a recording medium. The toner remaining on the surface of the photosensitive drum after the transferring is removed with a cleaning apparatus.

FIG. 7 and FIG. 8 are diagrams descriptive of the cleaning apparatus. The cleaning apparatus consists of a cleaning blade 91 having a blade 92 which functions to scrape the toner remaining after the transferring from the photosensitive drum and is supported by a supporting member 93, and a scooping sheet 95 which collects scraped toner remaining after the transferring. Furthermore, elastic members 97 made of a material such as foam polyurethane are disposed at both ends of the cleaning blade over a cleaner container so as to limitlessly narrow gaps between the blade and the elastic members, thereby preventing the scraped toner from leaking from the cleaner container. As a cleaner, the cleaning apparatus can recover the toner from only a range of an opening which is enclosed by the blade 92, the scooping sheet 95 and blade end seals as indicated by a meshed portion 98 in a schematic longitudinal view of a cleaner section as seen from the electrostatic latent image bearing member (photosensitive drum) shown in FIG. 7. Though the toner is developed on the photosensitive member usually within an image area, a small amount of scattered toner may adhere to the photosensitive drum outside the developing area. In order to allow the scattered toner to adhere in an amount as small as possible, the cleaning apparatus is constituted to reserve primary charging areas as large as possible at both ends outside an image area so that both ends hardly attract the toner. Even when the cleaning apparatus is constituted as described above, it is difficult to completely prevent the toner from adhering to both ends. It is therefore necessary to constitute the cleaning blade 91 and the scooping sheet 95 so as to have sufficient lengths in a longitudinal direction so as to clean a sufficient range including areas outside the image area.

Though urethane rubber is frequently used as a material of the blade 92 from a viewpoint of durability, a portion which is to be brought into contact with the electrostatic latent image bearing member is coated with fine particles of silicone resin or particles of fluorine to obtain a lubricating property since the urethane rubber has a high adhesive property and a low lubricating property.

Since the above described cleaning blade 91 is in contact with the electrostatic latent image bearing member 3 in a direction counter to its rotating direction A, a force is exerted in a direction indicated by an arrow F in FIG. 8. When a frictional force is excessive between the electrostatic latent image bearing member and the blade 92, the edge of the cleaning blade 92 may be turned over in the direction indicated by the arrow F, resulting in a turnover of the blade 92. The blade 92 which obtains the lubricating property owing to a lubricant applied over the edge of the blade 92 as described above is likely to turnover in an environment at a high temperature and a high humidity when the coated lubricant comes off.

Since the lubricant is only adhering to a surface of the blade 92 mainly physically and electrostatically, the lubricant has a relatively weak adhesive force and may come off due to sliding friction with the photosensitive drum and vibrations caused by sliding after a long time of use. In such a case, the toner remaining after the transferring and fogging toner (toner inverted in a polarity and developed in a white area which is originally not to be developed) are supplied to the image area, whereby the toners and an external additive contained in the toners function as a lubricant and provides an effect to prevent a turnover of the blade 92 from occurring. Outside the image area, however, powder materials such as the toner remaining after the transferring and the fogging toner which can function as the lubricant are scarcely supplied, so that the blade 92 is apt to turn over when the initially coated lubricant comes off.

SUMMARY OF THE INVENTION

An object of the present invention is to provide an image forming apparatus and a process-cartridge having a cleaning apparatus capable of carrying out cleaning favorably without any turnover of a cleaning blade even for long use.

An object of the present invention is to provide an image forming apparatus comprising:

- an electrostatic latent image bearing member;
- charging means for uniformly charging a surface of the above described electrostatic latent image bearing member;
- developing means for visualizing an electrostatic latent image formed on the above described electrostatic latent image bearing member with a developer;
- transferring means for transferring the visualized image to a transferring material; and
- cleaning means for cleaning surface by bringing a cleaning blade including an elastic blade into contact with surface,
- wherein a portion of the elastic blade to be brought into contact with the surface includes a resin film formed at least on surfaces of the portion at both ends of the elastic blade outside a developing area of the electrostatic latent image bearing member in a longitudinal direction of the elastic blade.

Furthermore, an object of the present invention is to provide a process cartridge comprising at least;

- an electrostatic latent image bearing member and cleaning means for cleaning a surface of the above described electrostatic latent image bearing member,
- wherein at least the above described electrostatic latent image bearing member and the cleaning means for cleaning the surface of the above described electrostatic latent image bearing member are integrated with each other and detachable from a main body of an image forming apparatus, and
- a cleaning blade has a portion which is to be brought into contact with the surface of the above described electrostatic latent image bearing member and at least resin films on surfaces at both ends outside a developing area in a longitudinal direction.

DETAILED DESCRIPTION OF THE INVENTION

Now, a description will be made of embodiments of the present invention with reference to the accompanying drawings.

First Embodiment

Figure 4:
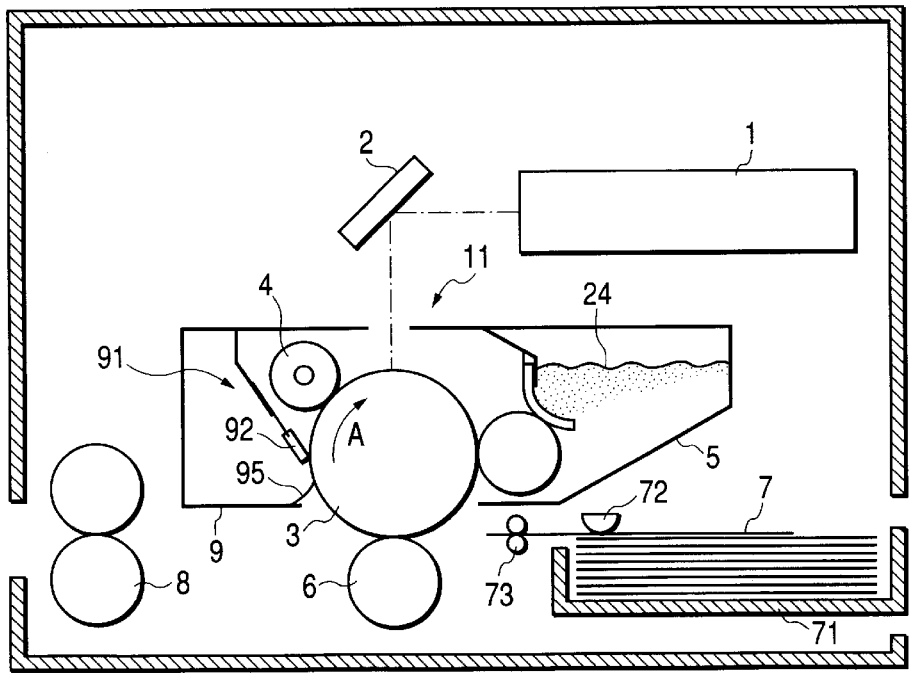
FIG. 4 is a schematic sectional view descriptive of a main body of an image forming apparatus according to the first embodiment of the present invention.

FIG. 4 is a schematic constitutional diagram of an image forming apparatus used in a first embodiment, in which a laser beam modulated in accordance with an image signal is scan output from a scanner unit 1 which comprises a laser, a polygonal mirror and a lens system, reflected by a reflection mirror 2 and projected to a photosensitive drum 3 which is an electrostatic latent image bearing member to form an electrostatic latent image. The photosensitive drum 3 is charged uniformly by a primary charger 4 consisting of a charging roller, and an electrostatic latent image is formed on a surface of the photosensitive drum 3 by irradiation with the laser beam. This electrostatic latent image is visualized as a toner image by a toner 24 contained in a developing apparatus 5. On the other hand, a recording material 7 (for example, plain paper) contained in a sheet feeding cassette 71 is fed by a sheet feeding roller 72 to a registration roller 73 in synchronization with formation of the electrostatic latent image on the photosensitive drum 3. The recording material 7 is conveyed by the registration roller 73 to a transferring charger 6 in synchronization with a leading end of the electrostatic latent image formed on the photosensitive drum 3 and the above described toner image is transferred by the transferring charger 6 to the above described recording material 7. The recording material 7 to which the toner image has been transferred is subjected to permanent fixing of the toner image by a heat and pressure fixing apparatus 8 and then discharged outside the image forming apparatus. The toner which remains on the photosensitive drum 3 is removed with a cleaning apparatus 9 using a cleaning blade 91 which has a blade 92 having elasticity. The cleaning apparatus 9 is disposed close to the photosensitive drum 3 which rotates in a direction indicated by an arrow A and an edge at an end of the blade 92 is in contact with the surface of the photosensitive drum 3 in a counter direction. The toner which remains after the transferring reaches a position of the blade 92 in a condition adhering to the photosensitive drum 3, and is scraped off by the blade 92, further guided by a scooping sheet 95 and accommodated into a cleaning container.

The present invention will be described below in detail based on FIG. 1.

Figure 1:
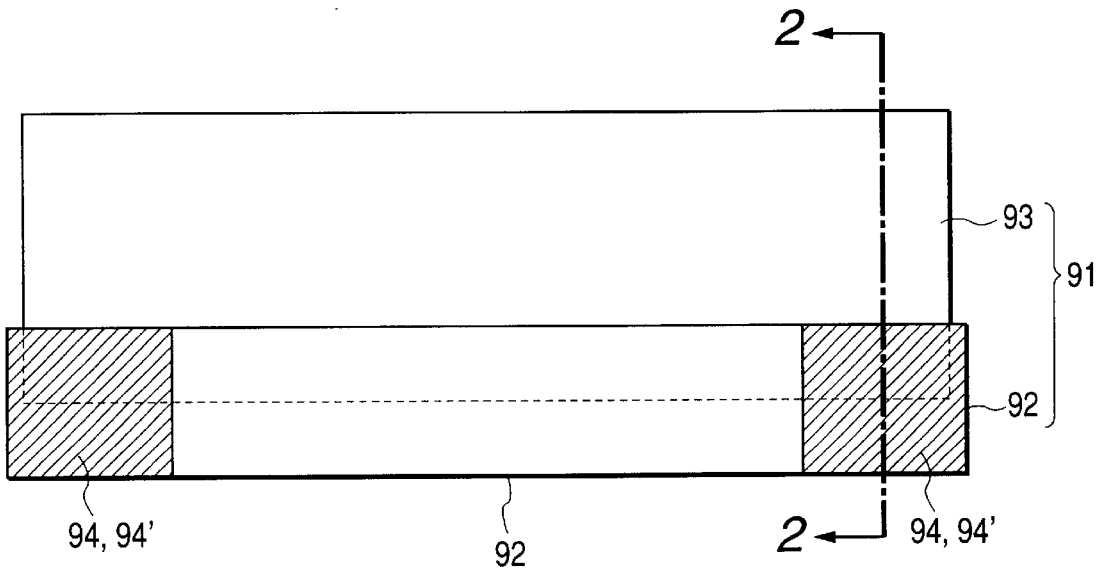
FIG. 1 is a schematic sectional view descriptive of a cleaning blade according to a first embodiment of the present invention.
Figure 2:
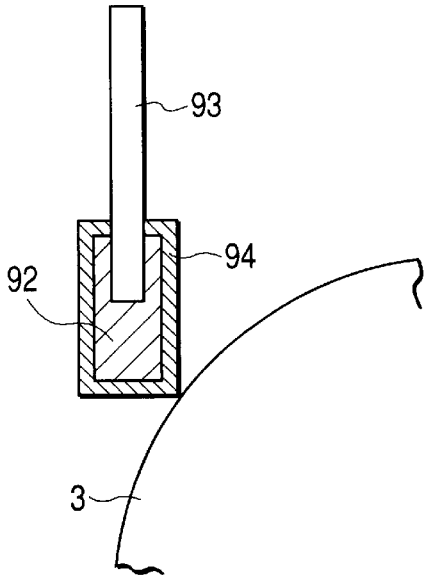
FIG. 2 is a sectional view taken along a 2—2 line of the cleaning blade shown in FIG. 1.
Figure 3:
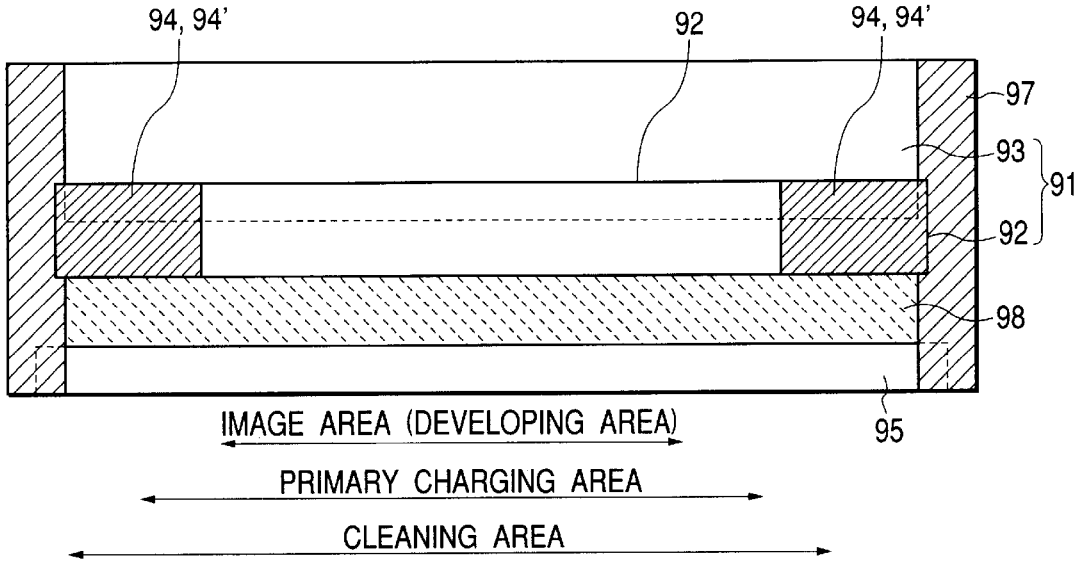
FIG. 3 is a diagram descriptive of a relation among a length of resin films 94 of a blade 92 in a longitudinal direction of a blade 92, a developing area, a primary charging area and a cleaning area.

FIG. 1 shows a front view of a cleaning blade 91 on which resin films are disposed, and FIG. 2 is a sectional view of the cleaning blade taken along a 2—2 line in FIG. 1. The cleaning blade 91 has a blade 92 made of urethane-based rubber which is bonded and fixed to a supporting plate metal 93. Resin films 94 are formed on surfaces at both ends outside a developing area in a longitudinal direction of the blade 92 and disposed so as to be brought into contact with the photosensitive drum 3.

Though the resin film 94 may be selected appropriately from among those which are generally used as coating materials, it is preferable to use a material which has a small coefficient of friction with the photosensitive drum 3 since the resin film 94 is always in frictional contact with the photosensitive drum 3. From such a viewpoint, mentionable as materials for the resin film 94 are polyamide resin, polyimide resin, silicone resin, polyacetal resin and fluorine-containing resin. Taking into consideration elasticity, permanent distortion and a durability of the blade 92 itself and an adhesive property to the blade 92, it is preferable that the resin film 94 has a thickness of 0.1 to 100 $\mu$m, more preferably of 1 to 20 $\mu$m. Mentionable as a method to form the resin film 94 is a method to bond a resin film to a blade surface, or a method to apply solvent-soluble resin using a brush, a roller or the like or by dipping.

A durability test was effected while passing sheets in an environment at a high temperature and a high humidity (30° C./80% Rh) using a cleaning blade 91 having a blade 92 which had a polyamide resin film 5 $\mu$m thick coated by dipping on surfaces at both ends outside a developing area in a longitudinal direction of the blade 92 made of urethane-based rubber and inside a primary charging area. A cleaning blade 91 which had a blade not coated with resin films was used for comparison. As an initial lubricant for these blades, fluorocarbon was applied over entire portions which were to be brought into contact with the photosensitive drum 3. As a result of the durability test, when the comparative blade was used, the initially applied lubricant was consumed when 15,000 sheets were passed through and a turnover occurred of the blade immediately thereafter. When the blade according to the first embodiment which had the coats at the ends was used, in contrast, cleaning was carried out favorably even after 20,000 sheets were passed though the initially applied lubricant was consumed when 13,000 sheets were passed through.

By forming resin films on the surfaces at both ends including the portion which was to be brought into contact with the electrostatic latent image bearing member and outside the developing area in the longitudinal direction as described above, it was possible to maintain a sufficient lubricating property and prevent the turnover of the blade from occurring even when the initially applied lubricant was peeled off.

Second Embodiment

A second embodiment is characterized in that lubricating fine particles are contained in the resin films formed at both ends of the blade of the cleaning blade described in the first embodiment.

When the fine lubricating particles are contained in the resin films, the fine lubricating particles exist on the portion of the blade which is to be brought into contact with the electrostatic latent image bearing member even after the initially applied lubricant is peeled off, thereby making it possible to maintain a lubricating property more effectively and prevent the turnover of the blade from occurring.

Figure 5:
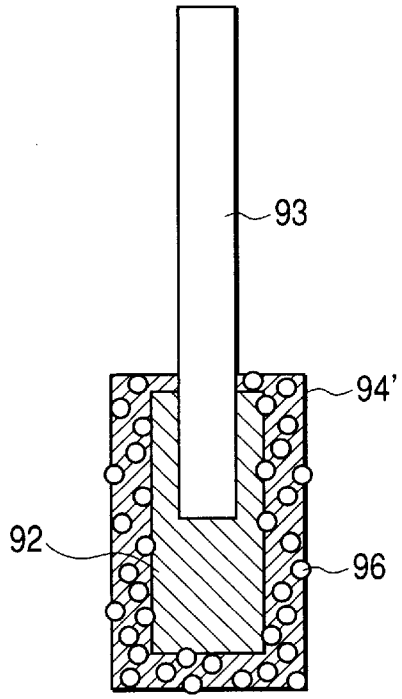
FIG. 5 is a schematic sectional view of a cleaning blade according to a second embodiment.

A description will now be made of the cleaning blade according to the present invention based on FIG. 5. A fundamental constitution remains unchanged from that described in the first embodiment and will not be described in particular. Lubricating fine particles 96 are contained in resin films 94' which are formed on surfaces at both ends outside a developing area in a longitudinal direction of a blade of a cleaning blade and inside the primary charging area.

Usable as the lubricating fine particles are inorganic substances and/or organic substances which are generally known as solid lubricants. Mentionable as the inorganic substances are talc, calcium carbonate, molybdenum bisulfide, silicon dioxide and graphite. Mentionable as the organic substances are fluorine-containing resin, polyamide resin, silicone resin and polyacetal resin. Fluorine-based compounds which have low frictional resistance in particular are preferable.

Suited as powder of a fluorine-based compound is graphite fluoride, polyvinylidene fluoride resin, tetrafluoroethylene resin, tetrafluoroethylene-hexafluoropropylene copolymer resin, tetrafluoroethylene-perfluoroalkoxyethylene copolymer resin, trifluoroethylene chloride resin or tetrafluoroethylene-ethylene copolymer resin.

As for a particle diameter of the lubricating fine particles, it is preferable that the particles have an average particle diameter of 20 $\mu$m or smaller so as not to lower a cleaning property of a toner, more preferably of 12 $\mu$m or smaller.

50 parts by weight of fluorocarbon having an average particle diameter of 1 $\mu$m was dispersed uniformly in a 100 parts by weight of polyamide resin, the dispersion was applied over surfaces at both ends outside a developing area in a longitudinal direction of a blade and durability tests were effected while passing sheets in an environment at a high temperature and a high humidity (30° C./80% Rh) as in the first embodiment. Fluorocarbon was applied as an initial lubricant over entire portions which were to be brought into contact with a photosensitive drum. As a result of the durability test, when a comparative blade having no resin layer at both ends was used, the initially applied lubricant was consumed when 15,000 sheets were passed through and a turnover occurred in the blade immediately thereafter. When the blade according to the second embodiment which had the coated ends in the longitudinal direction was used, in contrast, cleaning was carried out favorably even after 20,000 sheets were passed though the initially applied lubricant was consumed when 14,000 sheets were passed through.

By forming the resin films containing the lubricating fine particles on the surfaces of the blade of the cleaning blade including the portion to be brought into contact with the surface of the electrostatic latent image bearing member and outside the developing area in the longitudinal direction as described above, it was possible to maintain a sufficient lubricating property and prevent the turnover of the blade from occurring even when the initially applied lubricant was peeled off.

Third Embodiment

Figure 6:
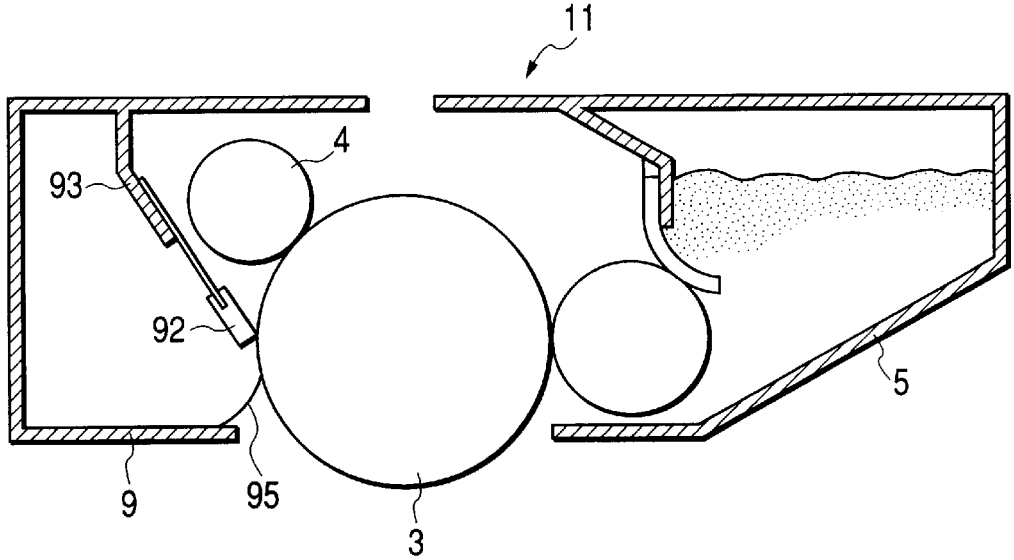
FIG. 6 is a schematic sectional view descriptive of a process-cartridge according to a third embodiment.
Figure 7:
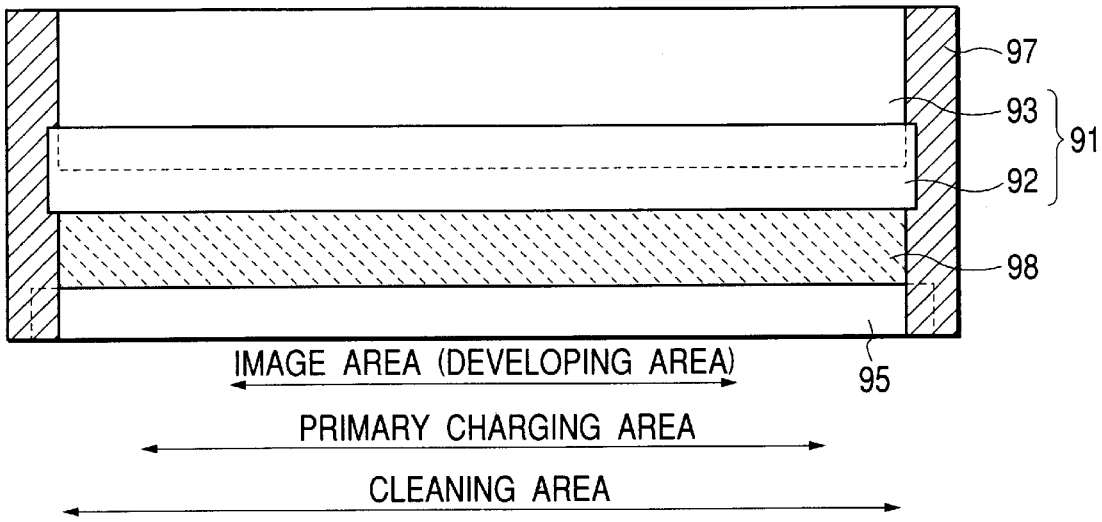
FIG. 7 is a diagram descriptive of a cleaning step.
Figure 8:
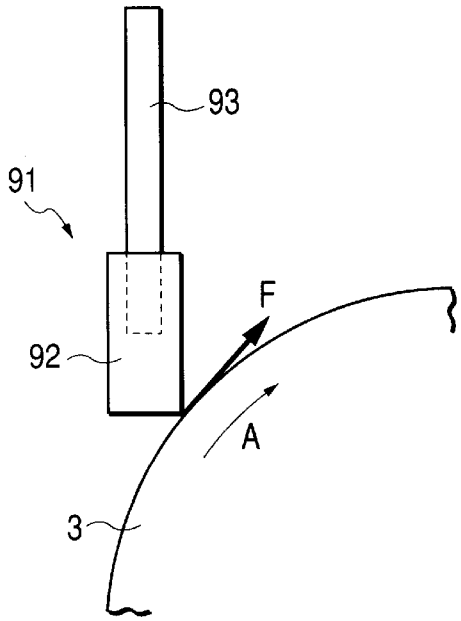
FIG. 8 is a diagram descriptive of a turnover phenomenon of a cleaning blade.

Next, a third embodiment of the present invention will be described with reference to FIG. 6.

A description will be made of a schematic constitution of a process cartridge. A process cartridge 11 is constituted as a unit consisting of the above described photosensitive drum 3, charging roller 4, developing apparatus 5, cleaning apparatus 9 which are integrated with one another. These component members are assembled in a cartridge in a predetermined relative positional relation and the cartridge is mounted at a predetermined location to a main body of an image forming apparatus so as to be detachable from the main body of the image forming apparatus.

When the image forming apparatus is used for a long time, various kinds of component members such as the photosensitive drum, the charger, the developing apparatus, the cleaning apparatus and the like are consumed, thereby lowering a print quality, but the image forming apparatus can be constituted as a maintenance-free cartridge type which allows a user to replace a process cartridge with a new one in such a case.

Though the cartridge type image forming apparatus allows the user to easily detach and attach cartridges when a recording sheet is jamming and detaching and attaching operations may accelerate the peeling off of the lubricant initially applied over the blade of the cleaning blade, use of the cleaning blade according to the present invention makes it possible to maintain a sufficient lubricating property even when the initially applied lubricant comes off, thereby carrying out cleaning favorably until a service life of a cartridge expires.

A first embodiment of the present invention provides an image forming apparatus which comprises an electrostatic latent image bearing member, charging means for uniformly charging a surface of the above described electrostatic latent image bearing member, developing means for visualizing an electrostatic latent image formed on the above described electrostatic latent image bearing member with a developer, transferring means for transferring a developer image formed on the above described electrostatic latent image bearing member to a transferring material and cleaning means for cleaning the surface of the electrostatic latent image bearing member by bringing a cleaning blade consisting of an elastic blade into contact with the surface of the above described electrostatic latent image bearing member, and uses a cleaning blade characterized by having resin films formed on surfaces at both ends including a portion of the above described cleaning blade to be brought into contact with the surface of the above described electrostatic latent image bearing member and outside a developing area in a longitudinal direction, thereby being capable of maintaining a sufficient lubricating property and preventing a turnover of a blade from occurring even when an initially applied lubricant comes off after long use.

Furthermore, a second embodiment of the present invention provides an image forming apparatus which uses a cleaning blade characterized on that resin films formed on the surface of the above described cleaning blade contain lubricating fine particles, whereby the lubricating fine particles which exist on a portion of the blade to be brought into contact can maintain a lubricating property and prevent the turnover of the blade from occurring even after an initially applied lubricant comes off for long use.

What is claimed is:

1. An image forming apparatus, comprising:

an electrostatic latent image bearing member;

charging means for uniformly charging a surface of said electrostatic latent image bearing member;

developing means for visualizing an electrostatic latent image formed on said electrostatic latent image bearing member with a developer;

transferring means for transferring the developed image to a transferring material; and cleaning means for cleaning said surface by bringing a cleaning blade including an elastic blade into contact with said surface, wherein said elastic blade includes contactable with said surface wherein resin films are formed on surface areas at both ends of said elastic blade outside a developing area of said electrostatic latent image bearing member in a longitudinal direction, and wherein a portion of said elastic blade corresponding to the developing area in the longitudinal direction is free of a resin film.

2. The apparatus according to claim 1, wherein said resin films include lubricating fine particles.

3. The apparatus according to claim 1, wherein said elastic blade is made of urethane-based rubber and said resin films are made of polyamide resin.

4. The apparatus according to claim 1, wherein said resin films are formed on said surface areas in areas corresponding to areas outside the developing area and inside a primary charging area of said electrostatic latent image bearing member in the longitudinal direction.

5. The apparatus according to claim 4, wherein said resin films are made of resin selected from a group consisting of: polyamide resin, polyimide resin, silicone resin, polyacetal resins and fluorine-containing resin; and wherein said elastic blade is made of rubber.

6. The apparatus according to claim 5, wherein said elastic blade is a urethane-based rubber and said resin films made of polyamide resin.

7. The apparatus according to claim 6, wherein said resin films include lubricating fine particles.

8. A process cartridge for use with an image forming apparatus, said process cartridge comprising:

an electrostatic latent image bearing member; and cleaning means for cleaning a surface of said electrostatic latent image bearing member, said cleaning means including an elastic blade, wherein said electrostatic latent image bearing member and said cleaning means are integrally formed and are detachable from a main body of the image forming apparatus, wherein said elastic blade includes a portion contactable with said surface wherein resin films are formed on surface areas at both ends of said elastic blade, which are outside a developing area of said electrostatic latent image bearing member in a longitudinal direction and, wherein said elastic blade is free of resin film at a surface area corresponding to the developing area in the longitudinal direction.

9. The process cartridge according to claim 8, wherein said resin films include lubricating fine particles.

10. The process cartridge according to claim 8, wherein said elastic blade is made of urethane-based rubber, and wherein said resin films are made of polyamide resin.

11. The process cartridge according to claim 8, wherein said resin films are formed on said surface areas in areas corresponding to areas outside the developing area and inside a primary charging area of said electrostatic latent image bearing member in the longitudinal direction.

12. The process cartridge according to claim 11, wherein said resin films are made of resin selected from a group consisting of:

polyamide resin, polyimide resin, silicone resin, polyacetal resin, and fluorine-containing resin; and wherein said elastic blade is made of rubber.

13. The process cartridge according to claim 12, wherein said elastic blade is made of urethane-based rubber, and wherein resin films are made of polyamide resin.

14. The process cartridge according to claim 13, wherein said resin films include lubricating fine particles.

* * * * *

UNITED STATES PATENT AND TRADEMARK OFFICE

CERTIFICATE OF CORRECTION

PATENT NO. : 6,640,081 B2
DATED : October 28, 2003
INVENTOR(S) : Hiroshi Sato

It is certified that error appears in the above-identified patent and that said Letters Patent is hereby corrected as shown below:

Title page,
Item [57], ABSTRACT,
Line 2, “charging” should read -- charging device --; and
Line 4, “developing” should read -- developing device --.

Column 2,
Line 9, “turnover” should read -- turn over --;
Line 21, “provides” should read -- provide --; and
Line 55, “least;” should read -- least: --.

Column 5,
Line 36, “a” should be deleted.

Column 6,
Line 4, “cleaning” should read -- and cleaning --; and
Line 52, “on that” should read -- in that --.

Column 7,
Line 6, “includes contactable” should read -- includes a portion contactable --;
Line 7, “surface” should read -- surface, --; and
Line 29, “polyacetal resins” should read -- polyacetal resin, --.

Column 8,
Line 8, “surface” should read -- surface, --; and
Line 12, “direction and,” should read -- direction, and --.

Signed and Sealed this

Sixth Day of April, 2004

JON W. DUDAS
*Acting Director of the United States Patent and Trademark Office*